US009427031B2

(12) United States Patent
Apostoloff

(10) Patent No.: US 9,427,031 B2
(45) Date of Patent: Aug. 30, 2016

(54) STORABLE PONCHO AND RELATED METHOD

(75) Inventor: David Apostoloff, Derry, NH (US)

(73) Assignees: David Apostoloff, Derry, NH (US); James D. Titus, Salem, NH (US)

( * ) Notice: Subject to any disclaimer, the term of this patent is extended or adjusted under 35 U.S.C. 154(b) by 875 days.

(21) Appl. No.: 13/408,569

(22) Filed: Feb. 29, 2012

(65) Prior Publication Data

US 2013/0212772 A1 Aug. 22, 2013

Related U.S. Application Data

(60) Provisional application No. 61/600,085, filed on Feb. 17, 2012.

(51) Int. Cl.
*A41D 3/00* (2006.01)
*A41D 15/04* (2006.01)

(52) U.S. Cl.
CPC ..... *A41D 3/00* (2013.01); *A41D 15/04* (2013.01); *A41D 2200/20* (2013.01)

(58) Field of Classification Search
CPC ..... A41D 2400/422; A41D 2400/424; A41D 3/00; A41D 1/02
See application file for complete search history.

(56) References Cited

U.S. PATENT DOCUMENTS 2,298,600 A 10/1942 Stember
2,383,748 A 8/1945 Sherman
3,670,340 A * 6/1972 Walker ..... 2/93
4,055,853 A 11/1977 Argento et al.
4,327,853 A 5/1982 Adams
5,452,476 A * 9/1995 Jenks ..... 2/46
5,564,125 A 10/1996 Waldman et al.
6,385,775 B1 5/2002 Komjati
6,715,160 B2 4/2004 Crye et al.
6,799,887 B1 10/2004 Kinney
7,395,555 B2 7/2008 Aldridge et al.
2008/0271222 A1 11/2008 Nienow
2009/0241235 A1 10/2009 Weinreb
2013/0212772 A1* 8/2013 Apostoloff ..... 2/93
2014/0373246 A1* 12/2014 Chapuis ..... 2/69

OTHER PUBLICATIONS

Notification of Transmittal of the International Search Report and the Written Opinion of the International Searching Authority from corresponding PCT/US2013/026354 mailed May 31, 2013.

* cited by examiner

*Primary Examiner* — Shaun R Hurley
*Assistant Examiner* — Andrew W Sutton
(74) *Attorney, Agent, or Firm* — Lando & Anastasi, LLP

(57) ABSTRACT

A storable poncho includes a belt having a first end, a second, opposite end configured to be releasably attached to the first end, an upper edge and a lower edge. The storable poncho further includes a first flap secured to the belt adjacent to one of the upper edge and the lower edge of the belt, and a body portion including fabric material configured to cover at least a portion of a user's body when worn. The body portion is secured to one of the upper edge and the lower edge of the belt. The body portion is covered by the first flap when configuring the body portion in a stored condition. Other embodiments of the storable poncho and methods for wearing a storable poncho are further disclosed.

11 Claims, 12 Drawing Sheets

STORABLE PONCHO AND RELATED METHOD

RELATED APPLICATION

This application claims the benefit of priority under 35 U.S.C. §119(e) to U.S. Provisional Application No. 61/600,085, entitled "STORABLE PONCHO AND RELATED METHOD," filed on Feb. 17, 2012, which is hereby incorporated by reference in its entirety for all purposes.

BACKGROUND OF THE DISCLOSURE

1. Field of the Disclosure

The present disclosure relates generally to garments, and more particularly to a storable poncho configurable to achieve a stored condition, a partially opened condition, and a completely opened condition.

2. Discussion of Related Art

A typical poncho is oftentimes fabricated from a single large sheet of fabric with an opening in the center for the user's head, and a piece of fabric that covers the user's head. Rainproof ponchos normally are fitted with fasteners to close the sides once the poncho is draped over the user's body, with openings provided for the user's arms. Sometimes, the piece of fabric covering the user's head is in the form of a hood attached near the opening that covers the user's head during use.

Traditionally, a person considering using a poncho during inclement weather has limited options. One option is to wear a garment that is specifically designed to be worn and re-worn by the user. Such ponchos are made of more robust material, and are stored in traditional ways, such as by hangers. Another option is to wear a garment that is specially designed for one-time use. Such ponchos are typically packaged in a compact condition, and users must open the packaging to remove and wear the ponchos. After use, the ponchos may be discarded, since they are made from thinner, less costly material, and are incapable of being easily stored. Also, such ponchos, prior to use, must be carried by the user, either by hand or within a storage device.

There is a need for a poncho that is capable of reuse, and is constructed in such a manner to be capable of being stored in a compact condition and easily carried.

SUMMARY OF THE DISCLOSURE

One aspect of the disclosure is directed to a storable poncho comprising a belt having a first end, a second, opposite end configured to be releasably attached to the first end, an upper edge and a lower edge. The storable poncho further comprises a first flap secured to the belt adjacent to one of the upper edge and the lower edge of the belt, and a body portion including fabric material configured to cover at least a portion of a user's body when worn. The body portion is secured to one of the upper edge and the lower edge of the belt. The body portion is covered by the first flap when configuring the body portion in a stored condition.

Embodiments of the storable poncho further may include the body portion having a jacket portion configured to cover at least a portion of an upper torso and arms of the user when worn. In one embodiment, the jacket portion may be secured to the upper edge of the belt and the first flap being secured to the upper edge of the belt. The storable poncho further may comprise a first fastener to releasably secure the first flap when configuring the jacket portion in the stored condition. In one embodiment, the first fastener may include hook and loop material provided on the belt and the first flap. The belt further has an inner surface disposed against the user when worn and an outer surface. The first flap has an inner surface disposed against the jacket portion when the jacket portion is in the stored condition. The hook and loop material of the first fastener may be secured to the outer surface of the belt adjacent the lower edge of the belt and is secured to the inner surface of the first flap. The storable poncho further may comprise a second flap secured to the lower edge of the belt, and a pants portion configured to cover at least a portion of a lower torso and legs of a user when worn. In one embodiment, the pants portion may be secured to the lower edge of the belt. The pants portion may be covered by the second flap when configuring the pants portion in a stored condition. The storable poncho further may comprise a second fastener to releasably secure the second flap when configuring the pants portion in the stored condition. In one embodiment, the second fastener may include hook and loop material provided on the belt and the second flap. The belt further may have an inner surface disposed against the user when worn and an outer surface. The second flap may have an inner surface disposed against the pants portion when the pants portion is in the stored condition. The hook and loop material of the second fastener may be secured to the outer surface of the belt adjacent the upper edge of the belt and is secured to the inner surface of the second flap.

Another aspect of the disclosure is directed to a method of wearing a storable poncho described herein comprising: securing the storable poncho around a waist of the user by securing the first and second ends of the belt with one another; moving the first flap away from the belt; removing the body portion from the stored condition to a use condition; and donning the body portion.

Embodiments of the method further may include releasing the first fastener of the first flap prior to moving the first flap away from the belt to access the body portion. The method further may include moving the second flap away from the belt, removing the pants portion from the stored condition to a use condition, and donning the pants portion. The method further may include releasing the second fastener of the second flap prior to moving the second flap away from the belt.

Another aspect of the disclosure is directed to a storable poncho comprising a belt having a first end, a second, opposite end configured to be releasably attached to the first end, an upper edge and a lower edge, a body portion including fabric material configured to cover at least a portion of a user's body when worn, the body portion being secured to one of the upper edge and the lower edge of the belt, and means secured to the belt adjacent to one of the other of the upper edge and the lower edge of the belt to store the body portion when configuring the body portion in a stored condition.

DESCRIPTION OF THE DRAWINGS

For a better understanding of the present disclosure, reference is made to the drawing figures which are incorporated herein by reference and in which.

DETAILED DESCRIPTION OF THE DISCLOSURE

Embodiments of the present disclosure are designed to be used and reused by persons who are performing activities during inclement weather, such as rain. In a certain embodiment, a storable poncho is constructed to achieve a stored condition, a partially opened condition, and a fully opened condition. In the stored condition, the storable poncho may be easily carried by a user since the storable poncho is configured to be worn by the user around the user's waist. In the partially opened condition, the storable poncho is capable of protecting an upper torso of the user, including the user's arms and head. In the fully opened condition, the storable poncho is capable of further protecting a lower torso of the user, including the user's legs.

In one embodiment, the storable poncho includes a belt that may be worn around the waist of the user. Ends of the belt may be secured to one another by snap fit fasteners, or another similar device, such as a belt buckle. The storable poncho also includes an upper flap, which is secured to the belt adjacent to an upper edge of the belt, and a jacket portion, which includes fabric material that is configured to cover the user's upper torso, including the user's arms and head. The jacket portion is secured to the upper edge of the belt as well. When in a stored condition, the jacket portion is covered and protected by the upper flap. A first fastener is further provided to releasably secure the upper flap when configuring the jacket portion in the stored condition and storing the jacket portion underneath the upper flap. In a certain embodiment, the first fastener may include hook and loop material provided on the belt and the upper flap, with a piece of hook and loop material being secured to an outer surface of the belt adjacent to the lower edge of the belt and another piece of mating hook and loop material being secured to the inner surface of the upper flap adjacent to an edge of the upper flap.

The storable poncho may also include a lower flap, which is secured to the lower edge of the belt, and a pants portion, which includes fabric material that is configured to cover the user's lower torso, including the user's legs. The pants portion is secured to the lower edge of the belt as well. When in a stored condition, the pants portion covers the upper flap (which in turn is covering the jacket portion) and is covered and protected by the lower flap.

It should be observed that during use, the jacket portion is first removed by releasing the hook and loop fastener of the upper flap. Once the jacket portion is removed, the user may optionally access the pants portion to remove them from the stored condition by releasing the hook and loop fastener of the upper flap. Both of these acts may be achieved while the user continues to wear the belt around the user's waist.

Figure 1:
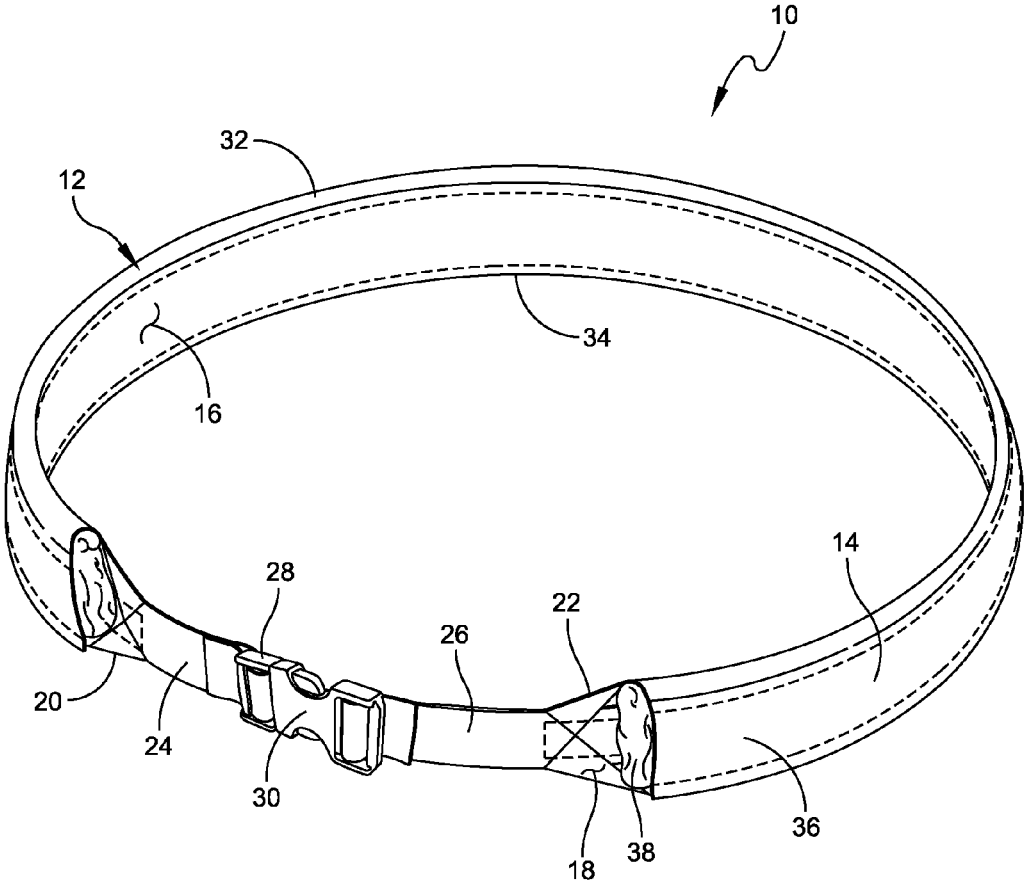
FIG. 1 is a perspective view of a storable poncho of an embodiment of the present disclosure in a stored condition with a belt assembly of the storable poncho shown in a connected condition.
Figure 2:
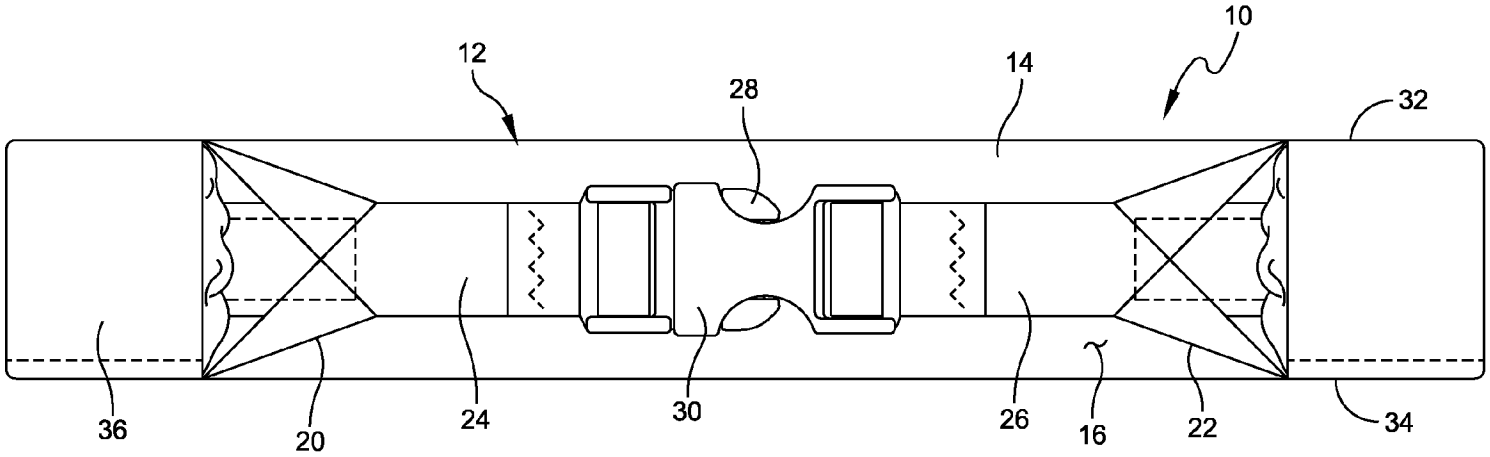
FIG. 2 is a front view of the storable poncho shown in FIG. 1.
Figure 3:
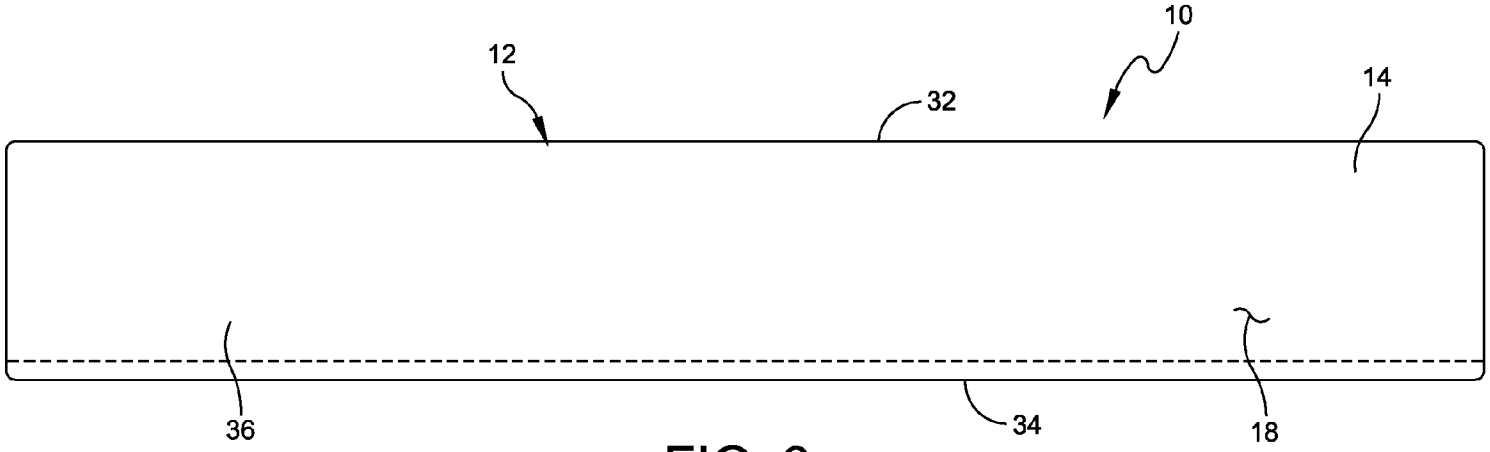
FIG. 3 is a back view of the storable poncho shown in FIG. 2.
Figure 4:
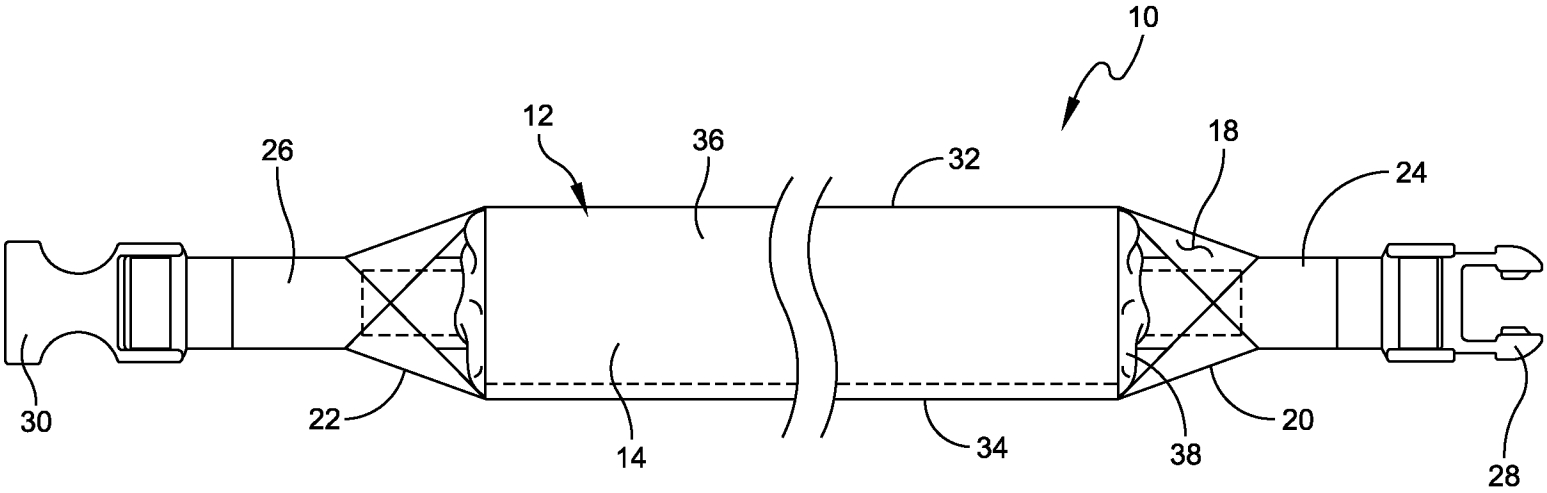
FIG. 4 is an enlarged front view of the storable poncho with the belt assembly shown in an unconnected condition.
Figure 5:
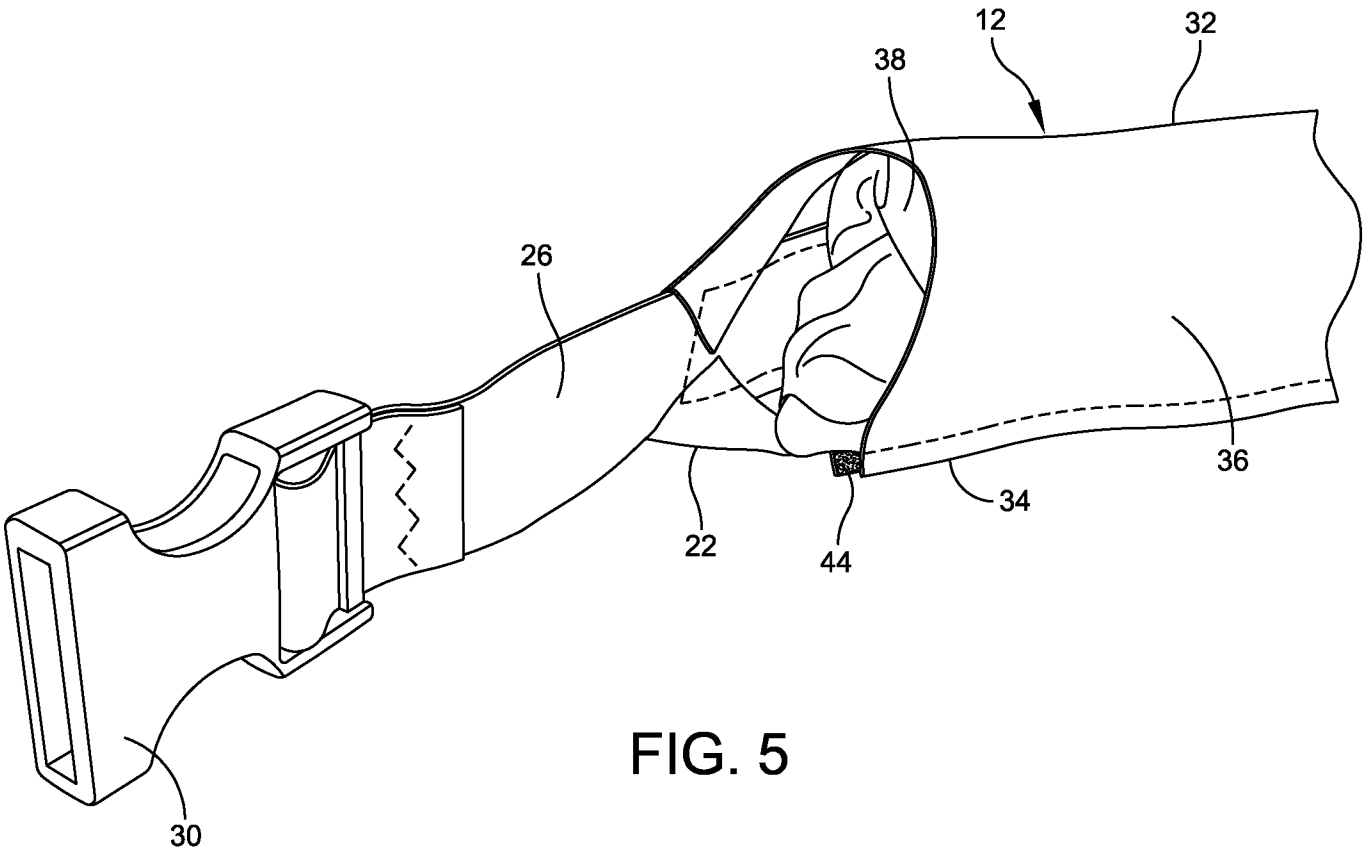
FIG. 5 is a perspective view of an end portion of the storable poncho.
Figure 6:
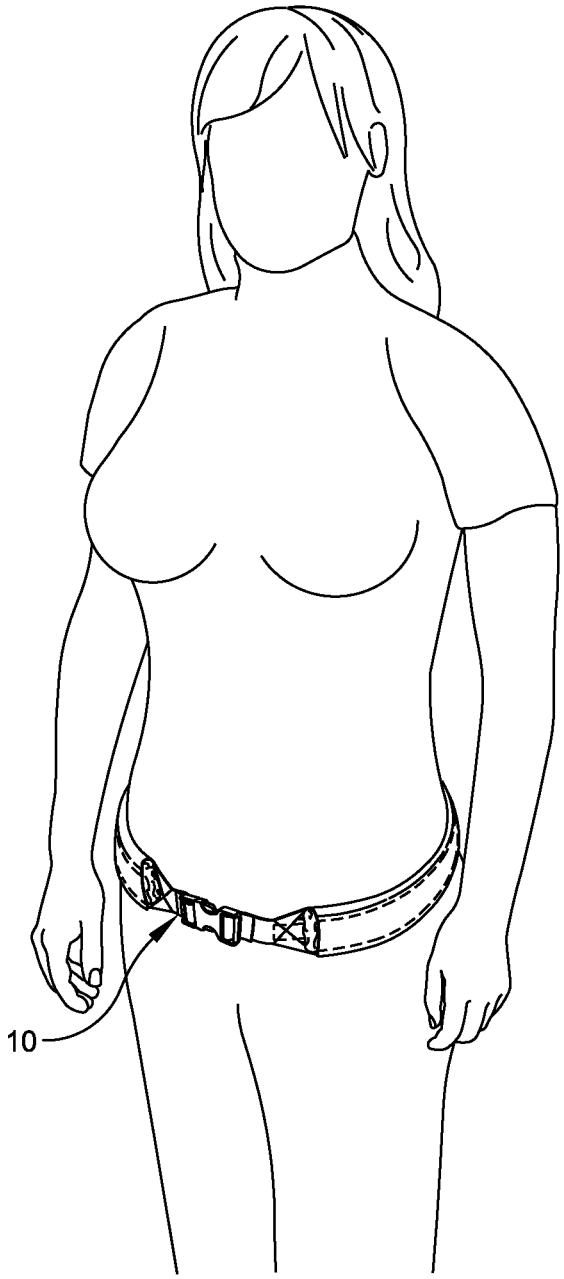
FIG. 6 is a perspective view of the storable poncho in the stored condition being worn.

Referring now to the drawings, and more particularly to FIGS. 1-7, there is generally indicated at 10 a storable poncho of an embodiment of the disclosure. As shown, the storable poncho 10 includes an elongate belt, generally indicated at 12, that is sized to fit around a waist of a user. The belt 12 includes a body 14 having an inner surface 16 disposed against the user when worn, an outer surface 18, a first end 20, and a second, opposite end 22 that is configured to be releasably attached to the first end. In one embodiment, the belt 12 may include strap portions 24, 26 made from elastic material, which are connected to respective ends 20, 22 of the body 14. The belt 12 may further include mating snap fasteners 28, 30, which are secured to the respective strap portions 24, 26, to secure the belt in a closed position around the user's waist (FIG. 6). The elastic strap portions 24, 26 enable the belt to accommodate a range of waist sizes. Other types of fasteners may be used in place of snap fasteners 28, 30, including belt buckles, and the like, which are suitably secured to the respective strap portions 24, 26 of the belt 12. The body 14 of the belt 12 further includes an upper edge 32 and a lower edge 34, the purpose of which will become apparent as the description of the storable poncho 10 proceeds. The belt 12 may be fabricated from any suitable strong fabric material, such as nylon, that is capable of withstanding the stress of being secured around the user's waist.

The storable poncho 10 further includes a first, upper flap 36 that is secured to the upper edge 32 of the belt 12. As shown, the upper flap 36 extends substantially along the entire length of the body 14 along the upper edge 32 of the belt 12, and may be secured to the belt in any suitable manner, such as by stitching. In another embodiment, the upper flap 36 may be integrally formed as part of the body of the belt 12. The upper flap 36 has a width that generally corresponds to a width of the body 14 of the belt 12. The storable poncho 10 also includes a body portion 38 that includes fabric material configured to cover at least a portion of the user's body when worn. In FIGS. 1-6, the body portion 38 is illustrated in a stored condition in which the body portion is covered and protected by the upper flap 36. In an alternative embodiment, the upper flap 36 may be secured to the lower edge 34 of the belt 12 (thus constituting a "lower flap") to cover and protect the body portion 38 in the stored condition. The body portion 38 may be moved to the stored condition by rolling or folding the body portion so that the body portion achieves a width that is capable of being covered by the upper flap 38.

Figure 7:
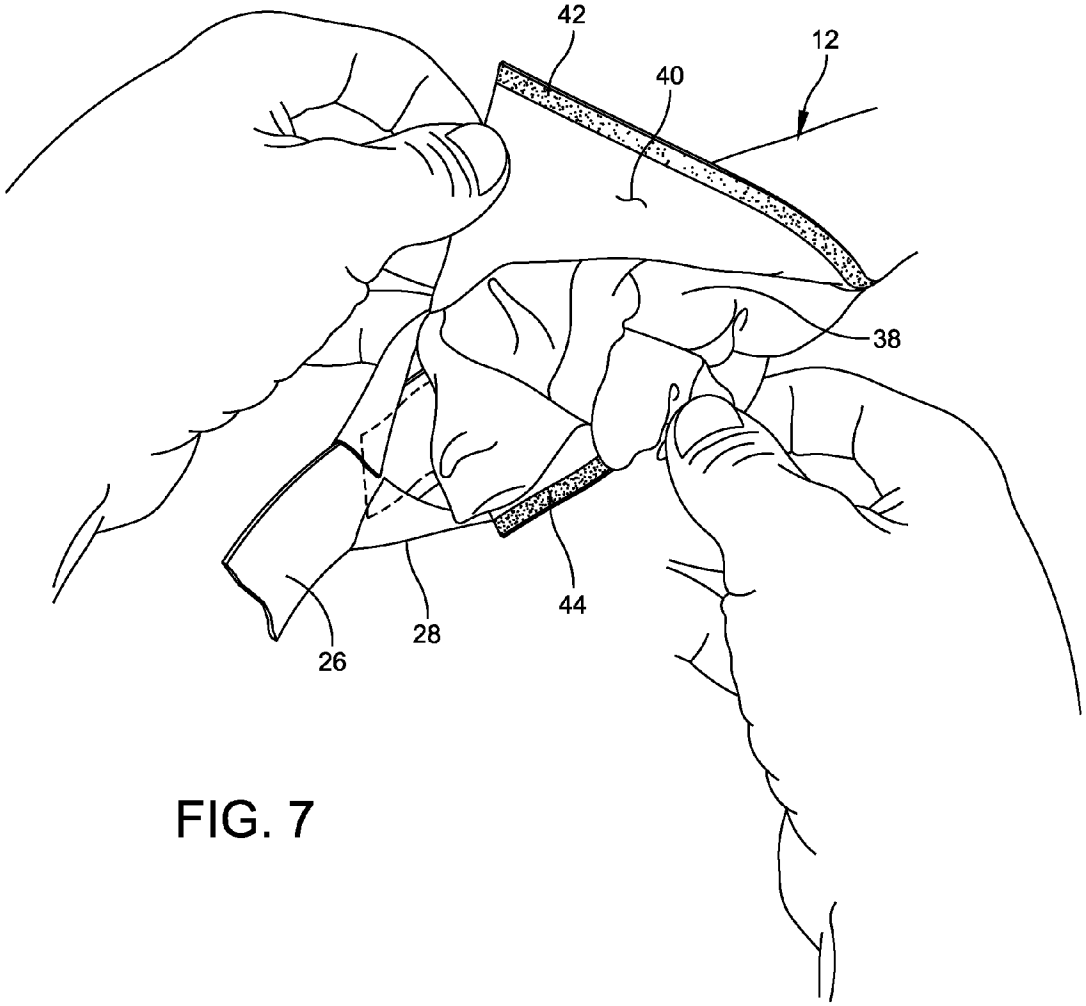
FIG. 7 is an enlarged perspective view of a portion of the storable poncho with an upper flap of the storable poncho being released.

Referring to FIGS. 5 and 7, the storable poncho 10 further includes a first fastener to secure the upper flap 36 in a position in which the upper flap covers the body portion 38 when in a stored condition. As shown, in FIG. 7, the upper flap 36 includes an inner surface 40 that is disposed against the body portion 38 when the body portion is in the stored condition. The first fastener includes a strip of hook and loop fastener material 42 attached (as by stitching) to the inner surface 40 of the upper flap 36 adjacent to an edge of the upper flap along a length of the upper flap. This strip of hook and loop fastener material 42 mates with another strip of hook and loop fastener material 44 that is secured to the body 14 of the belt 12 along a length of the lower edge 34 of the belt. The arrangement is such that the when the body portion 38 is in the stored condition, the upper flap 36 covers the body portion with the mating strips of hook and loop fastener material 42, 44 securing the upper flap in place. FIG. 7 illustrates a portion of the upper flap 36 being removed from the body 14 of the belt 12 to access the body portion for removal. Once the upper flap 36 is full released, the body portion 38 may be unrolled or unfolded to achieve an open or use condition.

Figure 8:
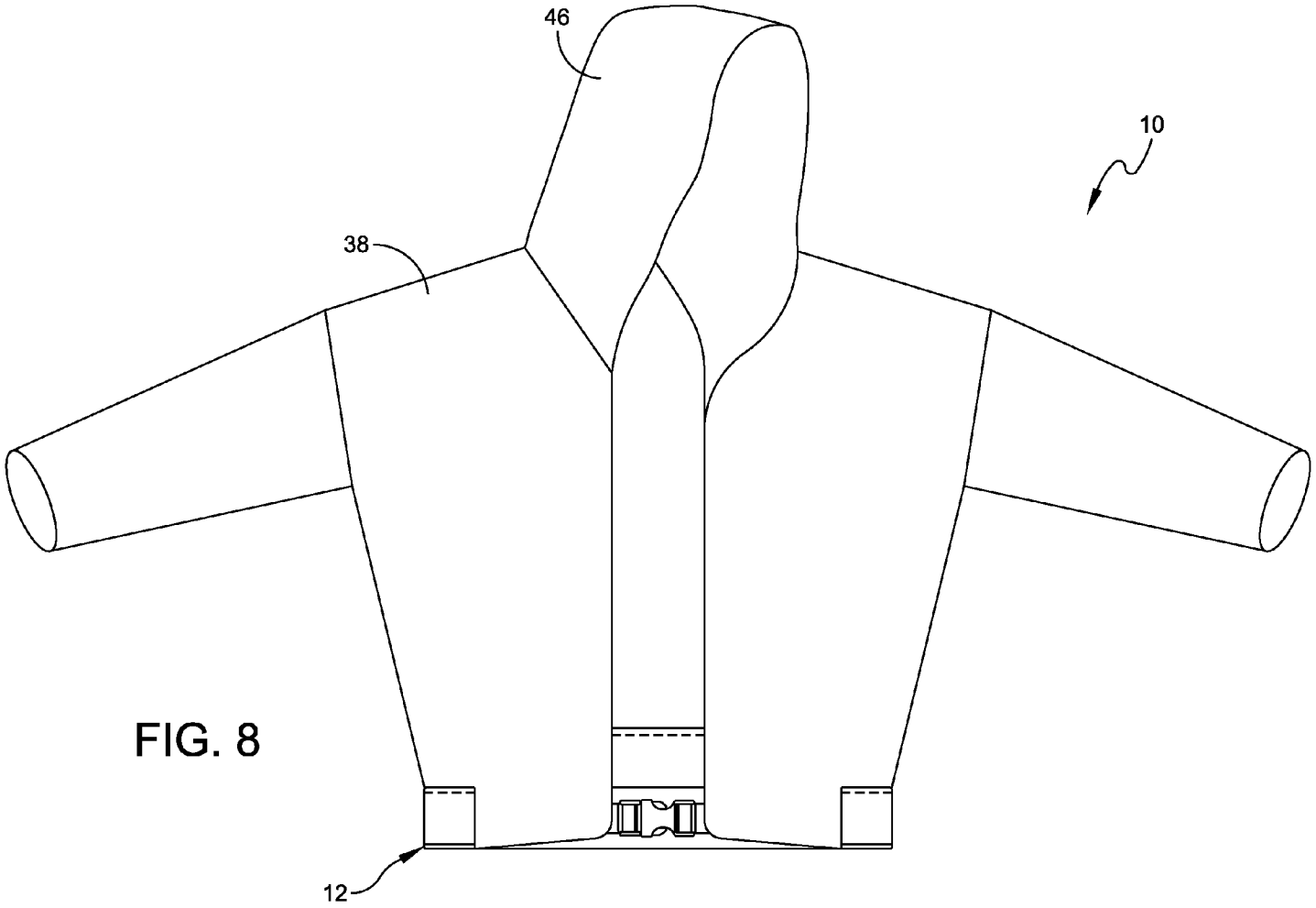
FIG. 8 is a front view of the storable poncho with a jacket portion of the storable poncho in an open or use condition.
Figure 9:
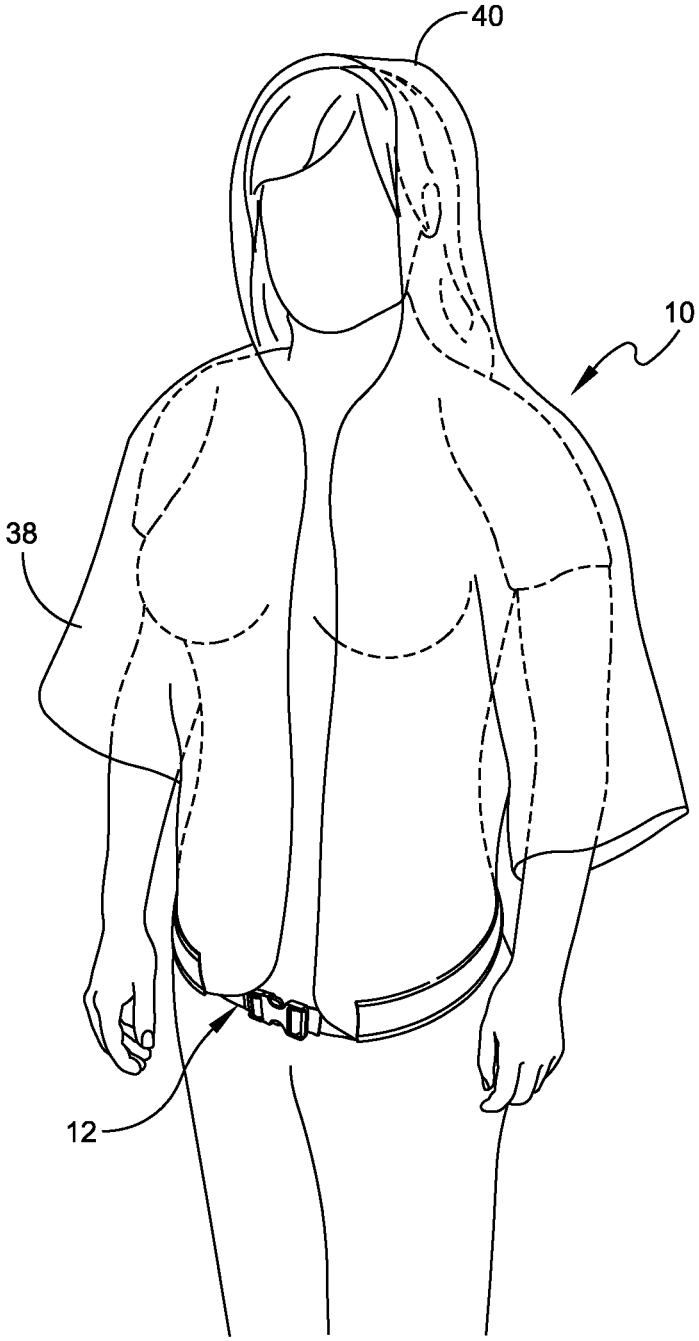
FIG. 9 is a perspective view of the storable poncho shown in FIG. 8 being worn.

Referring to FIGS. 8 and 9, the body portion 38 embodies a jacket portion, which, for the avoidance of confusion, is identified and referenced herein by reference numeral 38, and is configured to cover at least a portion of an upper torso and arms of the user when worn (see FIG. 9). As shown, the jacket portion 38 includes also includes a hood 46 to cover the user's head when worn. Although not shown, suitable fasteners may be provided to secure an open front of the jacket portion 38. In certain embodiments, such fasteners may include zippers, buttons, snaps, and the like. FIG. 9 illustrates the jacket portion 38 being worn by the user with the belt 12 still secured around the waist of the user.

Figure 10:
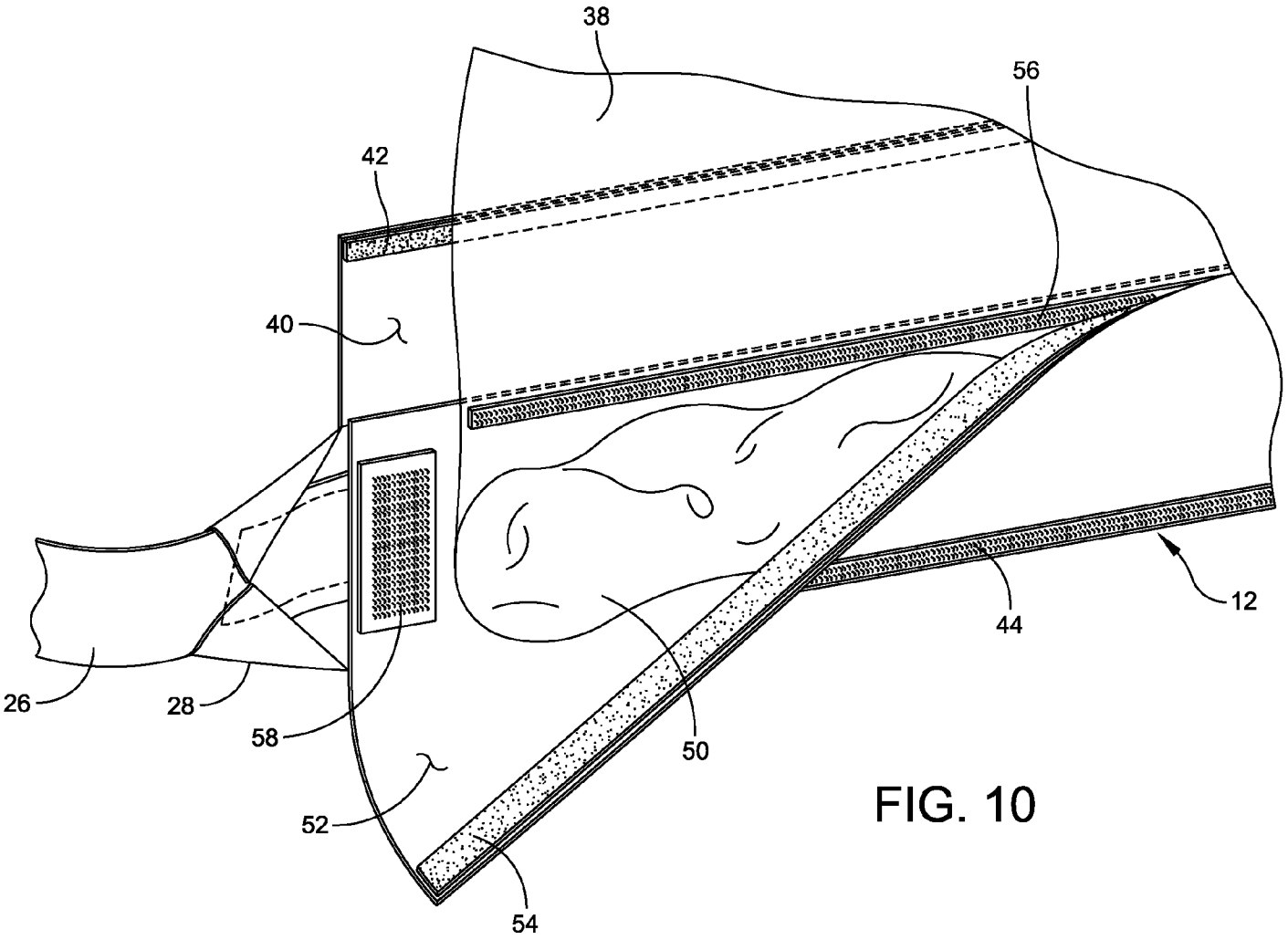
FIG. 10 is an enlarged perspective view of a portion of the storable poncho with a lower flap of the storable poncho being released.
Figure 11:
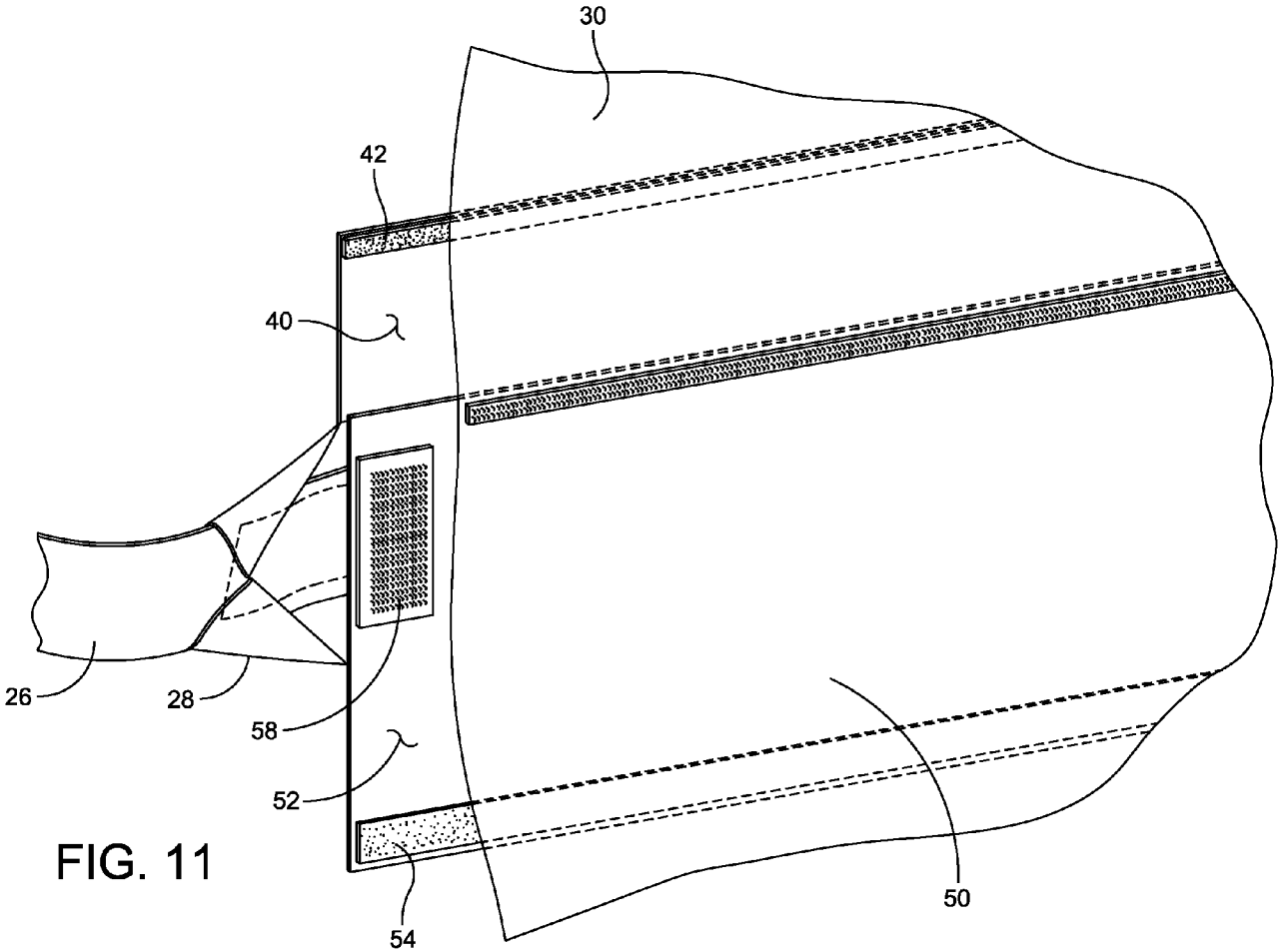
FIG. 11 is an enlarged perspective view of the portion of the storable poncho shown in FIG. 10 with the upper flap and the lower flap opened.

Referring to FIGS. 10 and 11, the storable poncho 10 further includes a second, lower flap 48 that is secured to the lower edge 34 of the belt 12. Similar to the upper flap 36, the lower flap 48 extends substantially along the entire length of the body 14 along the lower edge 34 of the belt 12, and may be secured to the belt in any suitable manner, such as by stitching. In another embodiment, the lower flap 48 may be integrally formed as part of the body 14 of the belt 12. The lower flap 48 has a width that generally corresponds to a width of the body 14 of the belt 12. The storable poncho 10 further includes a pants portion 50, which is configured to cover at least a portion of the user's lower torso and legs when worn. As used herein, the body portion 38, including the jacket portion, may be formed from the same sheet of material used to fabricate the pants portion 50. Thus, the body portion 38 may include both the jacket portion and the pants portion 50. As shown in FIGS. 10 and 11, the pants portion 50 is in a stored condition in which the pants portion is covered and protected by the lower flap 48. The pants portion 50 may similarly be moved to the stored condition by rolling or folding the pants portion so that the pants portion achieves a width that is capable of being covered by the lower flap 48.

The storable poncho 10 further includes a second fastener to secure the lower flap 48 in a position in which the lower flap covers the pants portion 50 when in the stored condition. As shown, the lower flap 48 includes an inner surface 52 that is disposed against the pants portion 50 when the pants portion is in the stored condition. The second fastener includes a strip of hook and loop fastener material 54 attached (as by stitching) to the inner surface 52 of the lower flap 48 adjacent to an edge of the lower flap along a length of the lower flap. This strip of hook and loop fastener material 54 mates with another strip of hook and loop fastener material 56 that is secured to the body 14 of the belt 12 along a length of the lower edge 34 of the belt, just below where the upper flap 36 is stitched to the body of the belt. The arrangement is such that the when the pants portion 50 is in the stored condition, the lower flap 48 covers the pants portion 50 with the mating pieces of hook and loop fastener material 54, 56 securing the lower flap in place. FIG. 10 illustrates a portion of the lower flap 48 being removed from the body 14 of the belt 12 to access the pants portion 50. Once the lower flap 48 is full released, the pants portion 50 may be unrolled or unfolded to achieve an open or use condition. FIG. 10 further illustrates a large strip of hook and loop material 58 that may be provided to better secure the ends of the upper and lower flaps 36, 48 in place.

Figure 12:
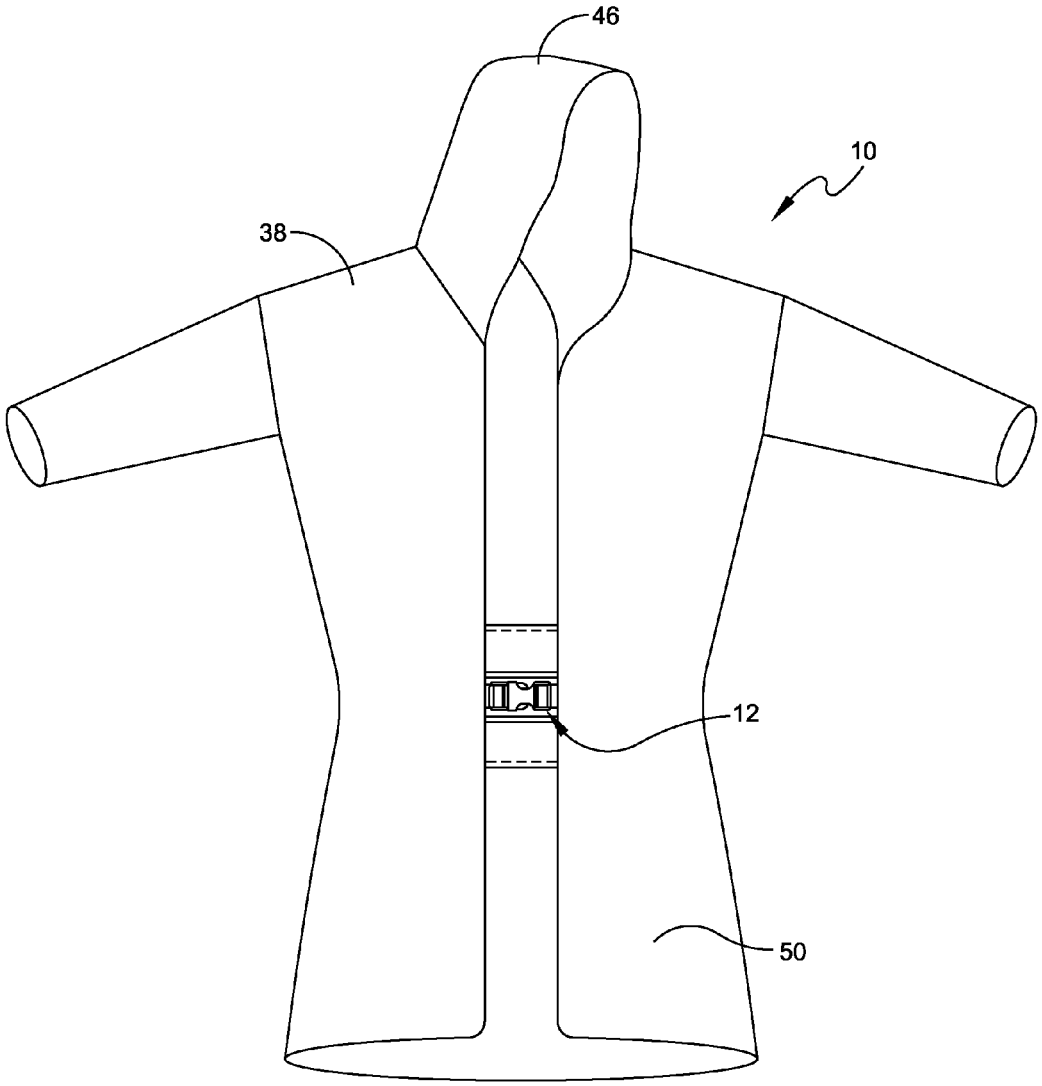
FIG. 12 is a front view of the storable poncho in a fully opened condition.
Figure 13:
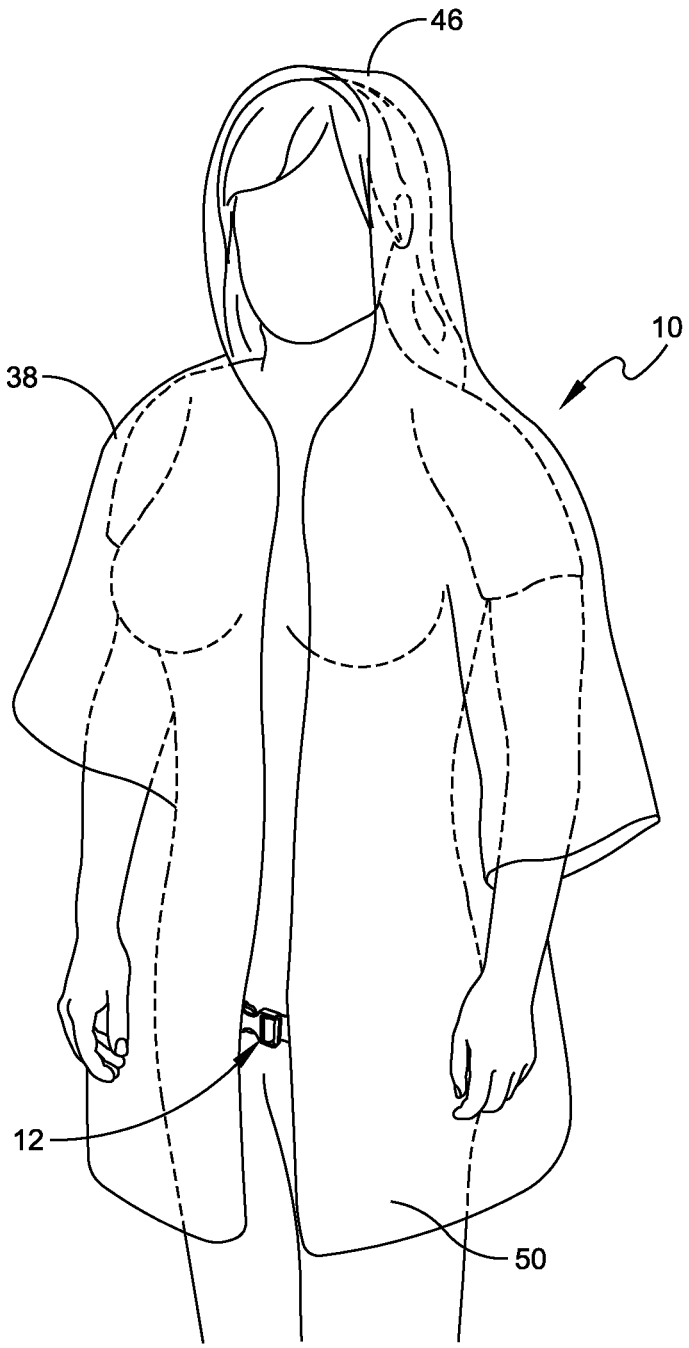
FIG. 13 is a perspective view of the storable poncho shown in FIG. 12 being worn.

Referring to FIGS. 12 and 13, the pants portion 50 is designed to cover the lower torso and a portion of the legs of the user when worn. It should be understood that the length of the pants portion 50 may be extended to cover more of the user's legs. As with the jacket portion 38, although not shown, suitable fasteners may be provided to secure an open front of the pants portion 50. In certain embodiments, such fasteners may include zippers, buttons, snaps, and the like. FIG. 13 illustrates the jacket portion 38 being worn by the user with the belt 12 still secured around the waist of the user.

In certain embodiments, the jacket portion 38 and the pants portion 50 of the storable poncho 10 may be fabricated from any suitable fabric capable of repelling moisture, such as lightweight coated nylon, or other synthetic materials.

As shown, the storable poncho 10 is designed to be worn and reused, and is capable of being carried in a stored condition. Specifically, during use, the storable poncho 10 may be secured around the waist of the user by securing the first and second ends 20, 24 of the belt 12 with one another with the snap fasteners 28, 30. Once secured, the user may remove the jacket portion 38 by moving the upper flap 36 away from the belt 12 to access the jacket portion. The jacket portion 38 may then be removed from the belt 12 from the stored condition to the use condition shown in FIG. 8 by unrolling or unfolding the jacket portion. Once removed, the jacket portion 38 is donned by the user in which the user inserts his or her arms into the arms of the jacket portion, which is shown in FIG. 9. The user may also place the hood 46 of the storable poncho 10 over the user's head.

After donning the jacket portion 38, if the user decides to protect his or her lower torso and legs, the user may move the lower flap 48 away from the belt 12 to access the pants portion 50 of the storable poncho 10. The pants portion 50 may then be removed from the belt 12 from the stored condition to the use condition shown in FIG. 12 by unrolling or unfolding the pants portion. Once removed, the pants portion 50 is donned by the user in which the pants portion covers the user's lower torso and legs, which is shown in FIG. 13.

After use, the user may remove the storable poncho 10 by releasing the snap fasteners 28, 30 of the belt 12. The user may roll up or fold the pants portion 50 and secure the pants portion in the stored condition by securing the lower flap 48 with the second fastener. Next, the user may roll up or fold the jacket portion 38 and secure the jacket portion in the stored condition by securing the upper flap 36 with the first fastener.

It should be observed that a variety of alternate designs or configurations of the storable poncho 10 may be provided and fall within the scope of the instant disclosure. For example, in one embodiment, the storable poncho 10 may include a body portion 38 having a jacket portion only. With this embodiment, the storable poncho 10 would be particularly suited for protecting the upper torso, arms and head of the user. Further, with this embodiment, the upper flap 36 may be provided on the lower edge 34 of the body 14 of the belt 12 to cover and secure the jacket portion 38. In another embodiment, although not preferred, the storable poncho 10 may include a body portion having a pants portion 50 only to protect the lower torso and legs of the wearer.

In certain embodiments, the preferred fasteners used to releasably secure the jacket and pants portions 38, 50 of the storable poncho 10 in a stored condition are strips of hook and loop fastener material. As known, hook and loop material is cost efficient, and may be easily manipulated by the user for quick deployment. However, it should be understood that a person skilled in the art, given the benefit of this disclosure, may replace the devices of hook and loop fastener material with other devices, such as snap fasteners, buttons, buckles, or any other suitable device designed to releasably secure the components in the stored condition.

Also, other design choices may be made. For example, the hood 46 provided on the jacket portion 38 of the storable poncho 10 may be eliminated. In addition, the jacket portion 38 and the pants portion 50 may be fabricated from a single sheet of matter that is attached (as by stitching) to the inner surface 16 of the body 14 of the belt 12. Moreover, the upper and lower flaps 36, 48 may be integrally formed with the body 14 of the belt 12.

This disclosure is not limited in its application to the details of construction and the arrangement of components set forth in the following description or illustrated in the drawings. The embodiments of the poncho disclosed herein are capable of other embodiments and of being practiced or of being carried out in various ways. Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A storable poncho comprising:

a belt having a first end, a second, opposite end configured to be releasably attached to the first end, an upper edge and a lower edge;

a first flap secured to the belt adjacent to the upper edge of the belt, the first flap extending along an entire length of the belt along the upper edge of the belt;

a jacket portion configured to cover at least a portion of an upper torso and arms of a user when worn, the jacket portion being secured to the upper edge of the belt, the jacket portion being covered by the first flap when configuring the jacket portion in a stored condition;

a second flap secured to the belt adjacent to the lower edge of the belt, the second flap extending along the entire length of the belt along the lower edge of the belt; and a pants portion configured to cover at least a portion of a lower torso and legs of the user when worn, the pants portion being secured to the lower edge of the belt, the pants portion being covered by the second flap when configuring the pants portion in a stored condition, wherein the second flap is disposed between the belt and the first flap when the jacket portion and the pants portion are in their respective stored positions.

2. The storable poncho set forth in claim 1, further comprising a first fastener to releasably secure the first flap when configuring the jacket portion in the stored condition.

3. The storable poncho set forth in claim 2, wherein the first fastener includes hook and loop material provided on the belt and the first flap.

4. The storable poncho set forth in claim 3, wherein the belt further has an inner surface disposed against the user when worn and an outer surface, and the first flap has an inner surface disposed against the jacket portion when the jacket portion is in the stored condition, and wherein the hook and loop material of the first fastener is secured to the outer surface of the belt adjacent the lower edge of the belt and is secured to the inner surface of the first flap.

5. The storable poncho set forth in claim 1, further comprising a second fastener to releasably secure the second flap when configuring the pants portion in the stored condition.

6. The storable poncho set forth in claim 5, wherein the second fastener includes hook and loop material provided on the belt and the second flap.

7. The storable poncho set forth in claim 6, wherein the belt further has an inner surface disposed against the user when worn and an outer surface, and the second flap has an inner surface disposed against the pants portion when the pants portion is in the stored condition, and wherein the hook and loop material of the second fastener is secured to the outer surface of the belt adjacent the upper edge of the belt and is secured to the inner surface of the second flap.

8. The storable poncho set forth in claim 1, wherein the body portion includes a pants portion configured to cover at least a portion of a lower torso and legs of a user when worn.

9. The storable poncho set forth in claim 8, further comprising a fastener to releasably secure the first flap when configuring the pants portion in the stored condition.

10. The storable poncho set forth in claim 9, wherein the fastener includes hook and loop material provided on the belt and the first flap.

11. The storable poncho set forth in claim 10, wherein the belt further has an inner surface disposed against the user when worn and an outer surface, and wherein the hook and loop material of the fastener is secured to the outer surface of the belt.

* * * * *